US005791735A

United States Patent [19]

Helman

[11] Patent Number: 5,791,735

[45] Date of Patent: Aug. 11, 1998

[54] HEADREST ASSEMBLY WITH USER ACTUACTED PIVOTAL SUPPORT ASSEMBLY

[75] Inventor: Donald L. Helman, Fresno, Calif.

[73] Assignee: Sunrise Medical HHG Inc., Longmont, Colo.

[21] Appl. No.: 680,814

[22] Filed: Jul. 16, 1996

[51] Int. Cl.[6] ..... A47C 7/38

[52] U.S. Cl. ..... 297/407; 297/404

[58] Field of Search ..... 297/391, 404, 297/406, 407, 408

[56] References Cited

U.S. PATENT DOCUMENTS

| | | | |
|---|---|---|---|
| 522,192 | 7/1894 | Browne | 297/407 |
| 547,390 | 10/1895 | Akeley | 297/410 |
| 573,147 | 12/1896 | Higgins | 297/405 |
| 1,686,631 | 10/1928 | May | 297/406 |
| 2,180,768 | 11/1939 | Peterson . | |
| 3,159,426 | 12/1964 | Kerr | 297/408 |
| 3,596,655 | 8/1971 | Corcoran | 128/75 |
| 3,719,388 | 3/1973 | Fortnam | 297/405 |
| 3,730,589 | 5/1973 | Lane | 297/391 |
| 3,761,126 | 9/1973 | Mulholland | 297/391 |
| 4,003,599 | 1/1977 | Takamatsu | 297/220 |
| 5,332,287 | 7/1994 | Whitmyer | 297/405 |

FOREIGN PATENT DOCUMENTS 10123 6/1900 European Pat. Off. .

*Primary Examiner*—Peter R. Brown
*Attorney, Agent, or Firm*—MacMillan, Sobanski & Todd

[57] ABSTRACT

A headrest [10] suitable for attachment to a wheelchair seating system, comprising: a cushioned backpad [12], a pair of laterally spaced apart cushioned sidepads [14], and a mounting assembly [20] located substantially to the rear of said headrest [10]. Said mounting assembly [20] enables said backpad [12] and said sidepads [14] to rotate together as a unit about a vertical axis located forward of said mounting assembly [20]. Said mounting assembly [20] is formed such that said vertical axis substantially coincides with the spinal column of a human patient seated in a wheelchair. The rotational range of backpad [12] and sidepads [14] is manually adjustable and limited to a prescribed range. A force is formed resisting rotational displacement in said backpad [12] and sidepads [14] returning said headrest [10] to a null, forward facing orientation. The strength of said force increasing with a corresponding increase in rotational displacement of said headrest [10].

6 Claims, 7 Drawing Sheets

38
70
54
48
52
42B
42A
20
50
54
48
34A
72
36A
46
36B
34B
16
26
10
60
62
24
32
12
62
14
14
60

HEADREST ASSEMBLY WITH USER ACTUACTED PIVOTAL SUPPORT ASSEMBLY

TECHNICAL FIELD

In general, the present invention relates to headrest assemblies and, more particularly, this invention relates to headrest assemblies for wheelchairs.

BACKGROUND ART

1. Wheelchair Headrest Assemblies

In the wheelchair industry, headrests are typically mounted on wheelchairs to provide proper support for the head and neck of the patient. Effective headrest assemblies for wheelchairs are especially important when dealing with patients who have limited control of their neck and head movement. For these patients, it is typically necessary to provide a headrest structure that both properly protects and also provides sufficient cradling support to the head, thus preventing excessive or unexpected movement of the neck and head which could endanger the patient.

Typically, headrest systems are designed to support a region partially encircling the back and sides of the patient's head. As a result, these systems prevent the head from tipping excessively either backwards or to the sides. The problem with many of these systems is that they also tend to rigidly restrain all motion in the head and neck regions. There exist a great number of patients who have full or partial control of their neck and head movements. These patients, of course, desire the ability to rotate or move their heads freely without having to work against the restraining effects of a typical headrest. When attempting to move their heads in a headrest support that is not adapted for some degree of motion, these patients typically must either exert their neck muscles against the frictional forces in the rigid headrest or first tilt their heads forward away from the headrest, then rotate their heads to the desired position, then tilt their heads backward into the cradling support of the headrest. Both of these approaches produce excessive and unwanted strain in the patient's neck muscles, with the latter approach providing no support to the patient's head during the critical period of time when it is moving.

Headrest assemblies have typically been designed for use on wheelchairs that are used with one of two groups of patients. The first group comprises patients who have very poor or minimal control of their neck and head and thus require their head to be both supported and restrained from excessive motion. The second group of patients comprises those that do not have these neck and head control problems, yet may still find a headrest assembly beneficial due to its additional comfort and support. These patients require a headset that does not excessively hinder their head and neck motion. It is important to remember that there also exists a large third group of patients who lie somewhere between the above two extremes. These patients have the capability of partial movement and control of their neck and head. Accordingly, what these patients require is support of their heads balanced with some freedom of movement. What these third group of patients require is a headrest system that is free to move with them, and yet provides sufficient support for their head and neck.

Consequently, in designing a single acceptable headrest system for a large number of different patients, a balance must be struck between a system which rigidly restrains all motion of the head and neck and a system which is either too loose or too flexible, allowing unrestrained head motion. This preferred system must also be adjustable such that a greater or lesser allowable range of motion could be pre-set for different patients.

As a result of the different needs of different patients, a long felt need exists for a headrest assembly which reduces stain in the patient's neck muscles by providing the necessary support to a patient's head, both when the head is stationary and also during the period of time when it is moving through a limited range of rotational motion. It is, of course, most preferable that this rotation be in a horizontal plane about the patient's own spinal axis. Ideally, the maximum range of this rotational displacement could be pre-set for each individual patient. Nevertheless, this system must also offer some gentle resistance to prevent excessive unrestrained rotational motion in the neck. The ability of the headrest to gently guide the patient's head back to a null, forward-looking orientation is also desired and would be especially important in the case of patients with limited strength or control of their neck movements. Ideally, this gentle guidance of the head back to a null, forward-looking orientation would be greater when the head is considerably displaced to the side and much less when the head is closer to the null, forward-looking orientation. This feature would not hinder the desired limited rotation of the head, but would protect the neck and head against large undesired rotational displacements. Lastly, this system must be comfortable and easy for the patient to use.

2. Specific Prior Art Systems

Although various headrests have been around for years, many are not adapted for the particular needs of patients in wheelchairs. The patent literature contains many examples of headrests for use on various other fixed chairs. For example, U.S. Pat. No. 4,003,599 to Takamatsu and U.S. Pat. No. 3,719,388 to Fortnam both disclose headrests. Both the Takamatsu and Fortnam patents disclose a large single support pad for the back of the head. Neither of these systems could be used in a wheelchair assembly as they disclose no support for the sides of the head and thus do nothing to restrain any unwanted side-to-side movement of the patient's head. Only persons having full muscular control of their neck and head could use either of these devices. Neither of these devices are intended to be used by physically challenged individuals.

Numerous headrest systems exist which are used to rigidly hold a patient's head in place. U.S. Pat. No. 3,596,655 to Corchoran discloses a traction cradle device having a pair of rear occipital cushions and a pair of chin cushions which securely clamp around the patient's head thereby restraining all movement in the neck and head. The Corchoran system is large, bulky, uncomfortable and allows for no free rotation of the neck about the spinal axis. It is, therefore, not relevant to the present invention.

Other headrest assemblies exist which are adjustably positioned, yet they are still designed to be locked into one final position such that the patient's head remains in one position. U.S. Pat. No. 573,147 to Higgins is an example of such a system, as is U.S. Pat. No. 547,390 to Akeley. Both the Higgins and Akeley devices are to be used with a surgical or dental chair, allowing the physician to first position the patient's head into a desired location to receive treatment. Both of these systems are not adapted to move under the control of the patient and there is no flexibility in these systems to support the patient's head while it rotates through a variety of positions. Although these systems are adjustable within a range of positions, they are both designed to be finally fixed into a chosen position. The patient does not control the positioning of these systems themselves. This is instead done by the attending physician or dentist. These systems aren't adapted to move with the rotation of the patient's head. Lastly, both of these devices provide support to the patient's head only when the patient is reclined at a considerable angle. Support is very limited when the patient's head is in a fully upright position.

Another form of restraint can be found in the 1992 brochure put out by Ortho/Kinetics Incorporated of Waukesha, Wis., describing its "HANS" system. This device restrains movement in the patient's head through a series of straps which are designed to immobilize the motion of the patient's head with respect to the patient's spine. This device prevents any rotational motion of the patient's head relative to the spine. It is not really a headrest system, but rather a head suspension system.

A variety of adjustable headrests exist which are positioned to support the back and to a lesser degree the sides of the patient's head. These headrests may be adjusted to be raised or lowered, tilted forwards or backwards and rotated about a vertical support. The limitation with these headrests is that they provide no real resistance against unwanted rotation of the head. Examples are found in U.S. Pat. No. 2,180,768 to Peterson and U.S. Pat. No. 3,730,589 to Lane. The Peterson headrest is designed for use on chairs in beauty parlors, and does not provide any restraining support for the sides of the head. Instead, it only provides support to the back of the neck. Since only minimal support is provided to the back of the neck, this device is best used with individuals who have full control of their neck and head movements. The Lane headrest, on the other hand, is specifically designed to be used with a wheelchair. It provides proper support to the back of the head, but having only two rear angled support cushions, it provides little real side support to prevent the head from dropping or tilting to the left or right. Furthermore, as was the case with Peterson, the Lane system provides no true restraining support to the head in a manner that would prevent the head from rotating to the left or right sides. Other limitations with the Peterson and Lane systems exist. Both the Peterson and Lane headrests are designed to be fixed or locked into only one position and are not designed to adjustably support the head through a limited range of motion. In addition, even if the Lane or Peterson systems could be loosened or modified such that they would be able to rotate freely in a horizontal plane to accompany the turning motion of the patient's head, the axis of such rotation would be through the supporting members in the headrest. This would position the axis substantially behind the vertical axis of the patient's spine. Thus, the patient using the modified systems would not be turning their head naturally around its spinal axis. Instead, the patient's head, neck and shoulders would be rotating about a vertical axis behind the spine. This unnatural motion would, of course, cause excessive and unwanted stresses and strains on the patient's head, neck and shoulder regions.

Another system which provides support and side restraint to a patient's head and is specifically made part of a wheelchair is found in U.S. Pat. No. 3,761,126 to Mulholland. The Mulholland system provides an adjustable wheelchair for children with cerebral palsy. A U-shaped neck pad wraps around the child's head and two control pads which project downwardly from positions adjacent to opposing sides of the child's head restraining the child's side-to-side head movement to the maximum possible degree. The main limitation with this system is that it allows for no potential for any free rotation of the neck. Rather, this system operates to hold the child's head firmly in place, restraining all neck and head motion. There is no mechanism to assist a user to turn their head if so desired. The headrest always remains locked in one position opposing such movement. Consequently, there is no potential for free rotation of the patient's head about the spinal axis. The Mulholland headrest is also somewhat large, bulky and uncomfortable.

Articulating headrests also exist which provide support both to the back and sides of a patient's head. Although they are somewhat adjustable, they are not adapted to provide continual support during rotation of the neck and are not adapted to rotate freely with the patient's neck movements. U.S. Pat. No. 5,332,287 to Whitmyer provides an example of such a system having an occipital pad and two large sub-occipital pads fully supporting the patient's head. The positioning of all three of these support pads is quite flexible. This feature allows Whitmyer to provide comfortable head support to patients with many different head shapes who do not have full control or use of their neck muscles. As such, it does represent a major improvement over prior art systems which had only used single or dual rear or side-rear pads for support. However, the Whitmyer headrest is simply not designed to move with and support the patient's head through a limited range of motion. Rather, the supporting cushions are first adjusted and then remain fixed in place locking the head in a particular position. Lastly, even if the support members of Whitmyer could be modified such that it would be possible to rotate freely in a horizontal plane, any rotation of the head that could be accomplished, (holding the head held firmly by the three pads), would require the head, neck and shoulders to be rotated about an axis passing through the vertical support member which is positioned directly behind the back of the head, rather than an axis coinciding with the patient's spinal column. As such, this rotation, even if possible, would place undue stress on the patient's head, neck and shoulder regions.

Finally, a headrest system exists wherein the head is supported through a limited degree of rotation and where the patient's head is also free to rotate about an axis which roughly coincides with their spinal column. U.S. Pat. No. 3,159,426 to Kerr discloses such a system. This headrest has a single large rear frame element which is cushioned to receive the back and sides of the patient's head. This headrest rotates on a laterally disposed arcuate track. Although the Kerr headrest does provide support for the head and neck through a range of motion, certain problems still remain with this system. The main problem is that there is no restraint mechanism to control either the ease or degree with which the patient's neck may rotate. Thus, the system allows the patient's head to quickly and easily twist far to the left or right. The head is thus prevented from tipping, but not from turning. Such a system could not be used to properly restrain the side-to-side rotational motion of a patient who had only limited control of their head or neck muscles. The Kerr system also lacks any natural ability to return the patient's head to a central forward pointing orientation. What would instead be desired is a system which, although able to easily accommodate some rotation of the patient's head, would also operate to provide a slight or gentle resistance to this motion thereby preventing the head from excessive degrees or speeds of rotation. A natural ability to return the patient's head to a forward pointing direction would also be an important feature of the optimal design. A final problem with the Kerr system is the fact that it moves on rollers which can be impeded by debris which may cause noise or vibration. A rotational system that avoids the need for these rollers would represent a substantial step towards an optimal design.

3. Objects of the Invention

It is an object of the present invention to provide a headrest assembly which provides comfortable support to a patient having limited muscular control in the neck and head regions.

It is another object of the present invention to provide comfortable cushioning support both to the rear and to the side portions of the patient's head.

It is another object of the invention to allow the patient to rotate their head freely under their own control in a horizontal plane within a limited range of motion.

It is another object of the present invention to provide a headrest assembly which provides comfortable support to a patient's head, both when the head is stationary and also when the head is rotating in a horizontal plane.

It is a another object of the present invention to provide comfortable support to a patient's head when the patient's head is rotating in a horizontal plane about a vertical axis which substantially coincides with the spinal column of the patient.

It is another object of the present invention to provide a headrest assembly able to accommodate a limited range of head rotation in a horizontal plane while additionally preventing rotation beyond a desired maximum range. It is a further object of this invention to have this maximum rotational range manually adjustable so that it can be pre-set for each individual patient.

It is another object of the present invention to provide a headrest assembly which tends to gently direct the patient's head back to a forward looking direction, while still being able to accommodate some rotational twist in the patient's neck should the patient desire to rotate their neck to a limited degree.

It is another object of the present invention to provide a headrest assembly which has an increasing tendency to return the patient's head to a forward looking direction corresponding to the increased rotational displacement of the assembly to the left or right.

It is a final object of the invention to provide a headrest assembly capable of rotating in a horizontal plane, avoiding the need for noisy, vibrating rollers.

DISCLOSURE OF THE INVENTION

The present invention discloses a headrest which is suitable for attachment to a wheelchair seating system. This headrest comprises a cushioned backpad, a pair of laterally spaced apart cushion sidepads, and a mounting assembly, said backpad and said sidepads being carried by said mounting assembly, and said mounting assembly extending rearwardly of said backpad and said sidepads to a wheelchair mounting structure, said mounting assembly including a plurality of forwardly extending arms pivotally connected between said mounting structure and said backpad and said sidepads and forming a linkage assembly, said linkage assembly being formed for rotation of said backpad and said sidepads together as a unit about a vertical axis located forward of said mounting structure and substantially coincident with the position of a spinal column of a human patient seated in the wheelchair with the patient's head supported on said backpad and said sidepads.

Said headrest further comprising a stop assembly moveably mounted and securable to said linkage assembly, said stop assembly formed to limit rotation of said linkage assembly to a prescribed range.

In addition, said linkage assembly is formed to exert a force to resist rotational displacement of said mounting assembly, and to return said mounting assembly to a null, forward facing orientation.

Also disclosed is a linkage assembly, suitable for use in a wheelchair headrest mounting assembly, said headrest mounting assembly providing a backpad and a pair of sidepads which rotate together as a unit about a vertical axis located forward of said mounting assembly and substantially coincident with the spinal column of a human patient seated in the wheelchair, comprising: a bottom forwardly extending arm formed for attachment to the frame of a wheelchair, a pair of substantially parallel lower intermediate forwardly extending arms positioned above and pivotally connected to said bottom forwardly extending arm, being mounted to said lower intermediate forwardly extending arms being mounted to move in a first horizontal plane above and parallel to said bottom forwardly extending arm, a pair of substantially parallel upper intermediate forwardly extending arms positioned above and pivotally connected to said pair of lower intermediate forwardly extending arms, each upper intermediate forwardly extending arm being pivotally connected to only one lower intermediate forwardly extending arm, and said upper intermediate forwardly extending arms being mounted to move in a second horizontal plane above and parallel to said first horizontal plane; and a top forwardly extending arm, positioned above and pivotally connected to said pair of upper forwardly extending arms, said top forwardly extending arm being pivotally connected to said pair of upper intermediate forwardly extending arms, and said top forwardly extending arm being mounted to move in a third horizontal plane above and parallel to said second horizontal plane.

BEST MODE OF CARRYING OUT THE INVENTION

Figure 1:
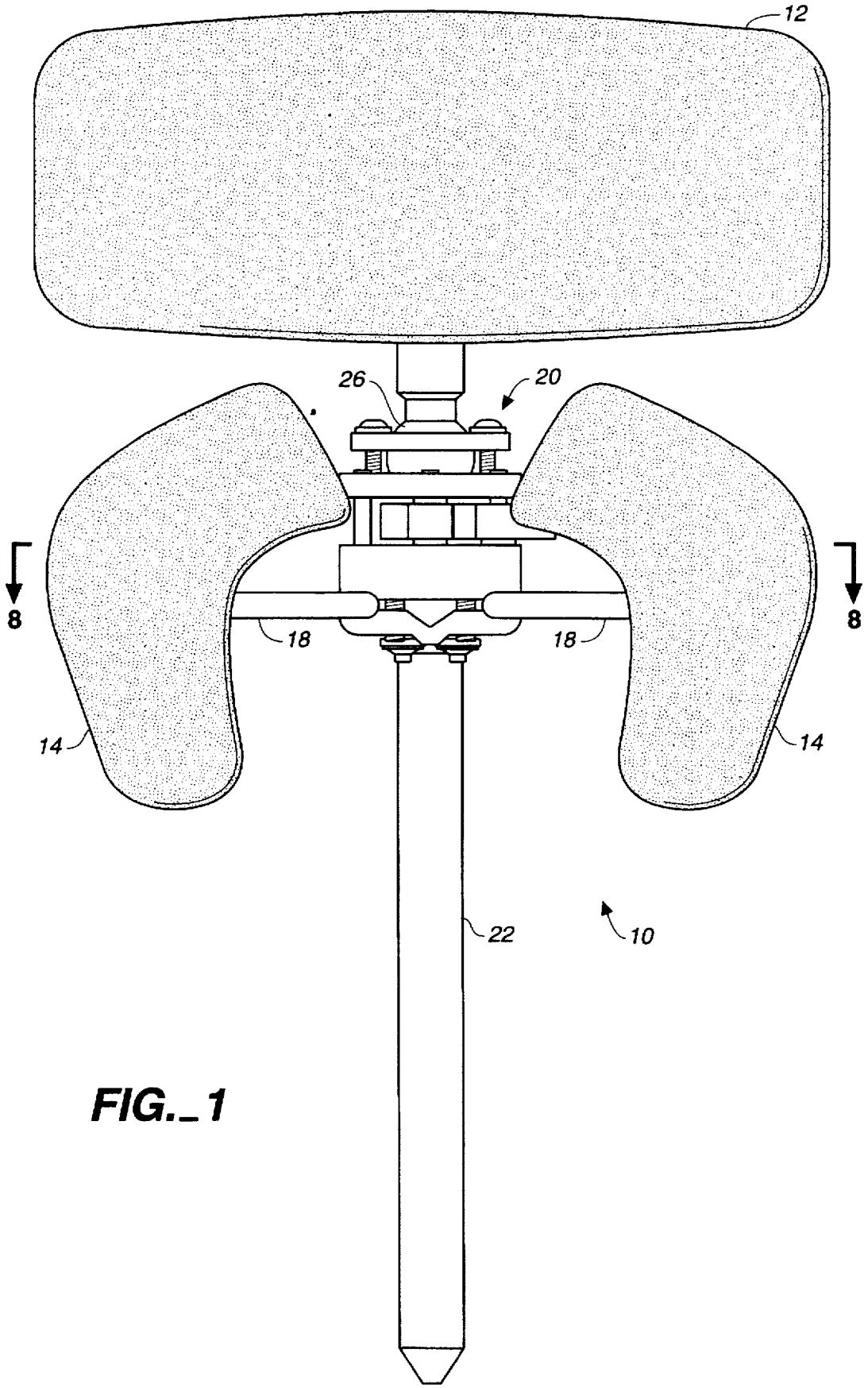
FIG. 1 is a front elevational view of a headrest assembly constructed in accordance with the present invention.

In the design of headrest assemblies for wheelchairs, a number of factors need to be taken into account. First, each patient has a unique head shape. Secondly, patients in wheelchairs vary tremendously in the degree of control they are able to exert over their neck and head movements. Whereas some patients require considerable external support and restraining balance for their head, others do not. A major problem in the design of headrest assemblies has been to provide firm, comfortable support and balance for those patients requiring such support, while not providing excessive restraint of motion for those patients who wish to rotate their head under their own power. Finding a balance between these competing concerns has proven difficult. Especially problematic has been the question of how to provide support and balance to the head during actual rotation motion, when the head is rotating in a horizontal plane about the vertical axis of the spinal column.

Prior art systems which provided cushioning support and balancing to the head in order to ease the strain on the patient's neck muscles have also unfortunately tended to unnecessarily restrain any rotational motion. This restraint in turn increases strain in the patient's neck as the patient's neck muscles move their while trying to overcome the frictional resistance in the non-moving support, or instead, the neck muscles must carry the full weight of the head while holding it away from the headrest during movement. On the other hand, headrest systems which do allow for rotation of the head have tended to suffer from three main problems. First, if the motion is not damped or restrained, the patient's head may become free to unexpectedly slide to the left or right sides. This is especially dangerous for patients with limited control of their neck muscles as these sliding movements are unwanted and can be quite sudden. Secondly, the patient's rotational range of motion in these freely rotating systems has tended to be quite large, allowing for a large rotational displacement in the patient's neck. The magnitudes of these displacements, even if limited at all by the system, generally are not so limited as to be adjustable for each individual patient. Thirdly, the rotational displacement of the head itself tends to be about a vertical axis which does not substantially coincide with the patient's spinal column. When this form of rotation occurs, the head and shoulders of the patient tend to rotate together as a unit about an axis which is instead defined by structural members of the headrest assembly. This unnatural motion adds unnecessary strain to the patient's neck and shoulders as they are forced to make this movement. One final added problem in designing an optimal headrest system is providing the feature of gently re-directing the head to a forward looking position without such re-direction causing unnecessary restraint of desired horizontal rotation of the head. This has not been seen in the prior art. The present invention overcomes the above limitations as set out below.

Figure 2:
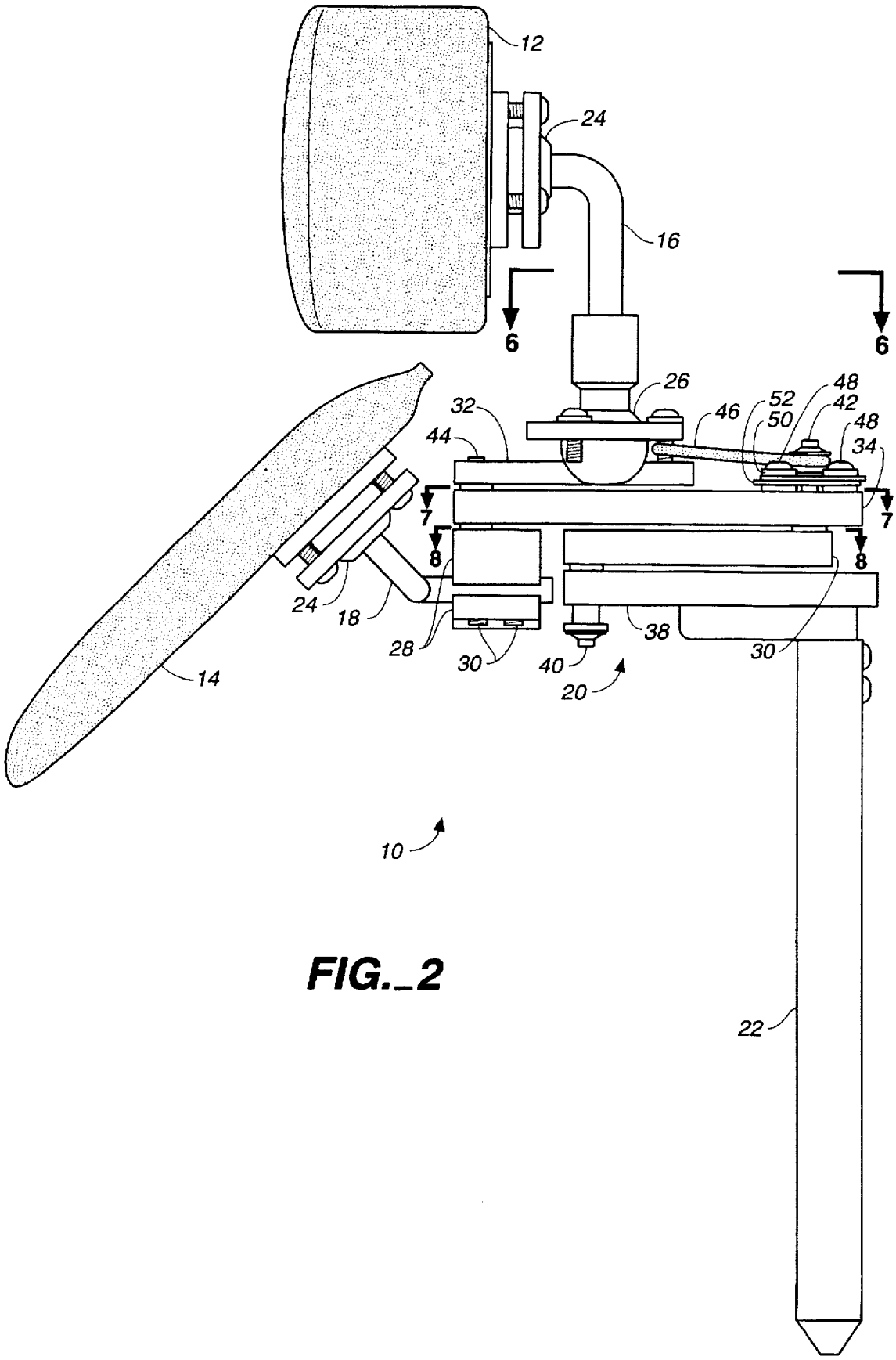
FIG. 2 is a side elevational view of the headrest assembly of FIG. 1.

The present headrest provides comfortable support and protection to the patient's head at the back and sides. As is best seen in FIGS. 1 and 2, the headrest assembly 10 provides cushioning support through a rear pad or cushion 12 and two side pads or cushions 14, which engage the rear and sides of the patient's head respectively. To enable cushions 12 and 14 to be positioned so that they best fit the particular individual patient seated in the chair, pivoting assemblies 24 connect the support cushions 12 and 14 to structural members 16 and 18, respectively. These pivoting assemblies 24 are composed of a ball and socket type joint which allows pivoting of cushions 12 and 14. This pivoting action allows cushions 12 and 14 to be tilted and oriented such that they best firmly contact the head of the particular patient sitting in the wheelchair, thus accommodating different shapes and sizes of heads of different patients. An additional pivoting assembly 26 connects extension member 16 to the mounting assembly 20. The mounting assembly (20) extends rearwardly of said backpad (12) and said sidepads (14) to a wheelchair mounting structure (22). Pivoting assembly 26 is composed of a ball and socket type joint. Pivoting assembly 26 permits cushion 12 to be moved in a back and forth direction thus enabling even greater flexibility in positioning cushion 12 to the particular shape of the patient's head. Side cushions 14 may also be adjusted in a back and forth direction since structural members 18 are received into a vice type bracket which holds structural members 18 in place. Bolts 30 in bracket 28 can be loosened such that structural members 18 can be slid slightly forward and backward, thus giving another dimension of movement in positioning cushions 14. After adjusting structural member 18 to the particular head shape of the patient, bolts 30 are tightened in place fixing the side cushions 14 in position. Operating together, cushions 12 and 14 provide comfortable support to the rear and sides of the patient's head. Balancing for the patient's head is also provided by these supporting cushions. This balancing is especially important to patients having limited strength in their neck muscles or limited control of their head and neck movements.

The present invention provides support and balancing to the patient's head not only when the head is stationary, buy also through limited degrees of motion. To accomplish this, the supporting cushions 12 and 14 must be able to move with the rotation of the head. The mechanism to accomplish this function is found in the unique design of mounting assembly 20 which guides the motion of the cushions 12 and 14. Mounting assembly 20 comprises a plurality of four forwardly extending arms 32, 34, 36 and 38 which together comprise a linkage assembly. The movement of these forwardly extending arms with respect to one another allows the patient to have freedom to rotate their head to a limited degree. The method of functioning of forwardly extending arms 32, 34, 36 and 38 is explained in more detail below.

Connectors 40, 42 and 44 separate the various forwardly extending arms 32, 34, 36 and 38 and enable these arms to pivotally rotate freely about the points through which the respective connector passes. Connectors 40, 42 and 44 join arms 32, 34, 36 and 38 together in the following manner. Connector 40 joins arms 36 and 38. Connector 42 joins arms 34 and 36 together. Connector 44 joins arms 32, 34 and bracket 28 together. The pivotal rotation of these forwardly extending arms about the points where the connectors pass through them is more clearly seen when FIG. 2 is viewed in conjunction with FIGS. 3, 4, and 5.

Support and balancing of the patient's head is provided at all degrees of rotational motion. As can best be seen in FIG. 3, the headrest apparatus is seen in its natural resting forward-looking orientation. A patient's head 60 is shown in phantom positioned against cushions 12 and 14. The approximate location of the vertical axis passing through the patient's spine is shown at location 62. The present invention allows for rotation of the patient's head about this vertical axis coinciding with their spinal column at location 62. The directions of possible rotation of the headrest assembly 10 are shown by arrows 60 and 62. Arrow 60 shows rotation in the counter-clockwise from above direction and arrow 62 shows rotation in the clockwise from above position.

Said linkage assembly is formed for rotation of said backpad (12) and said sidepads (14) together as a unit about a vertical axis (62) located forward of said mounting structure.

Figure 3:
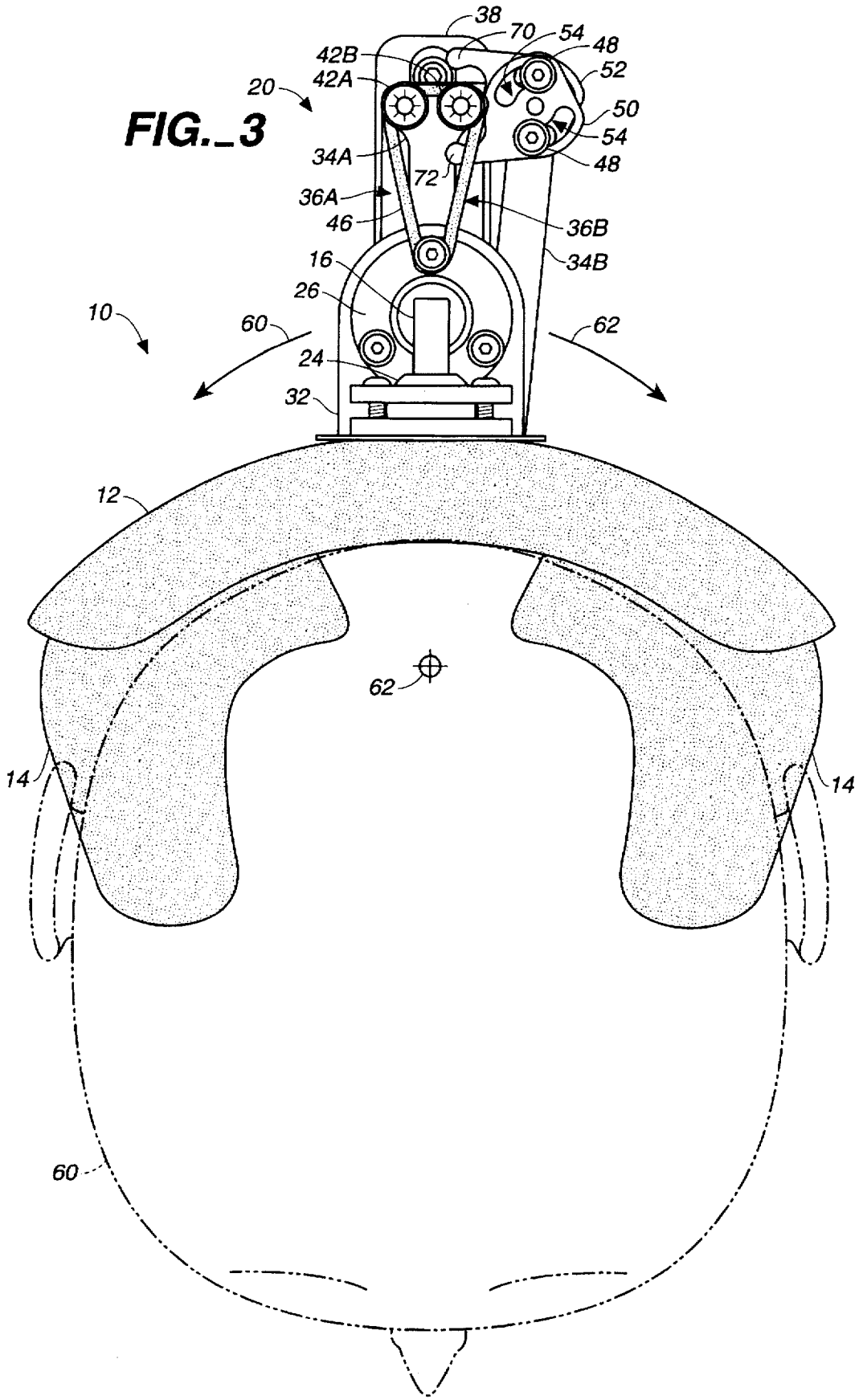
FIG. 3 is a top plan view of the headrest assembly in its rest or forward pointing orientation, with the patient's head shown in phantom.
Figure 5A:
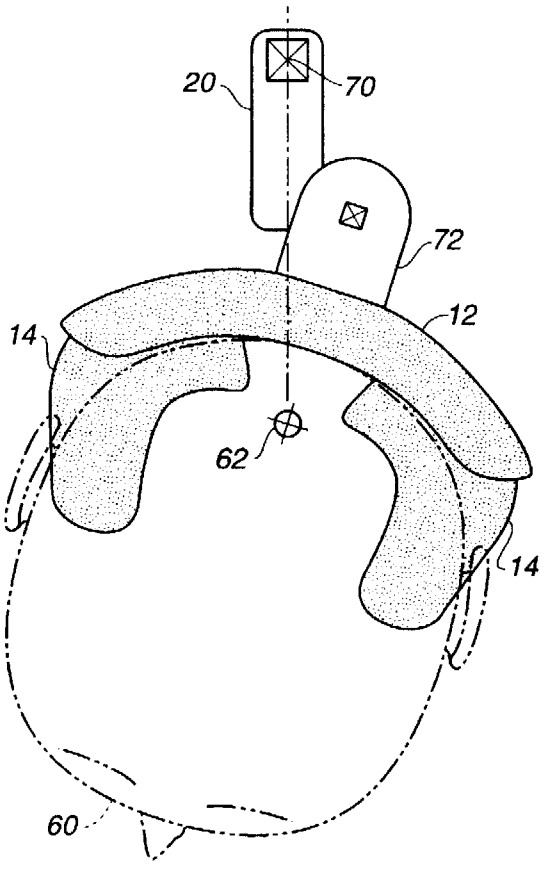
FIG. 5A is a top plan, reduced scale, schematic view of the headrest assembly corresponding to FIG. 5.
Figure 4A:
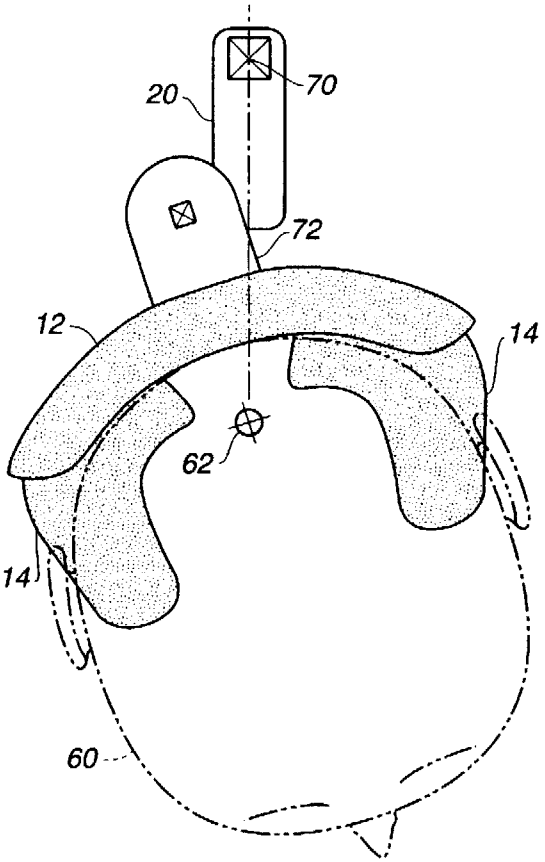
FIG. 4A is a top plan, reduced scale, schematic view of the headrest assembly corresponding to FIG. 4.
Figure 4:
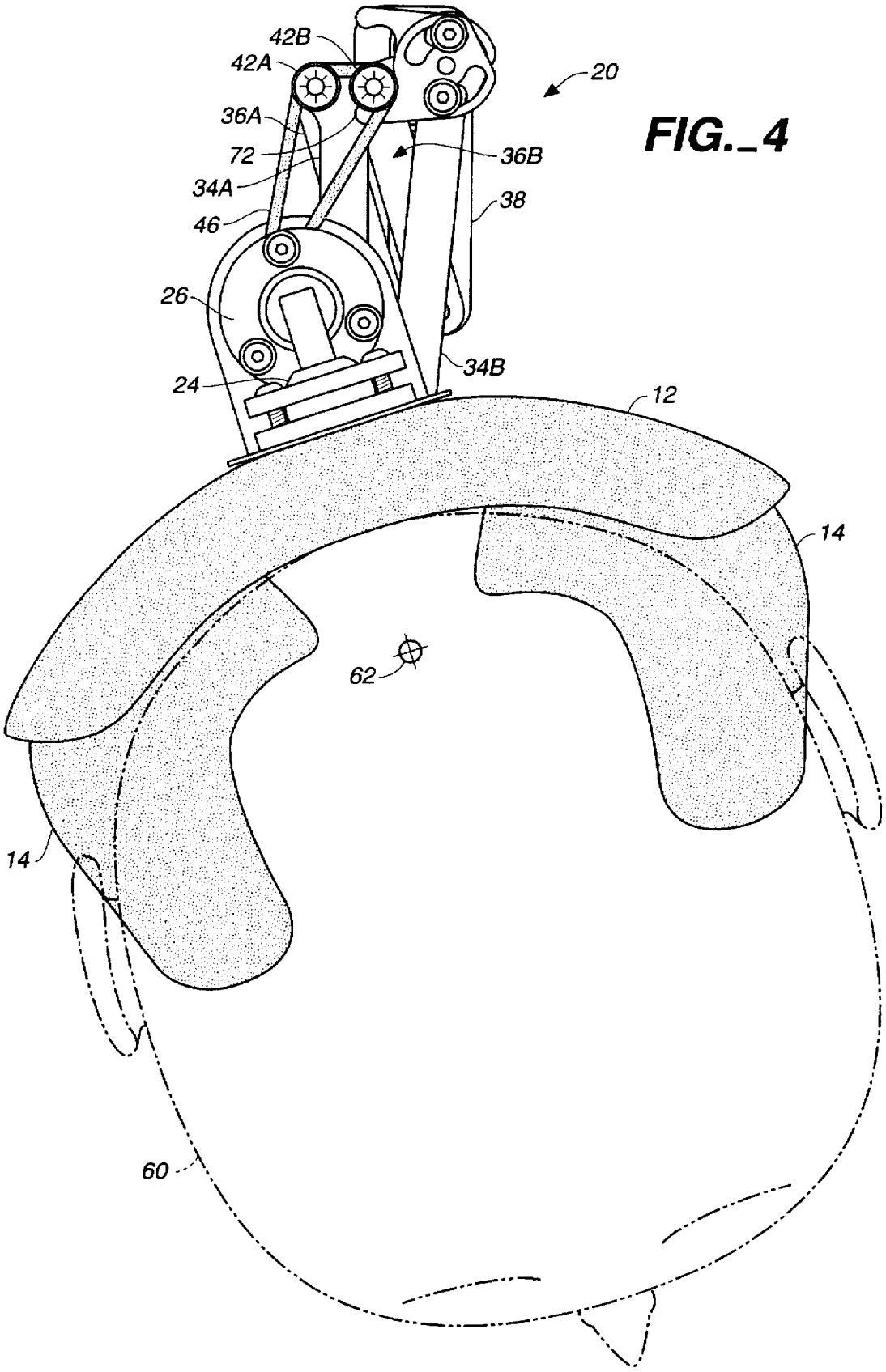
FIG. 4 is a plan view of the headrest assembly showing rotation of the assembly counter-clockwise from FIG. 3, with the patient's head shown in phantom.
Figure 5:
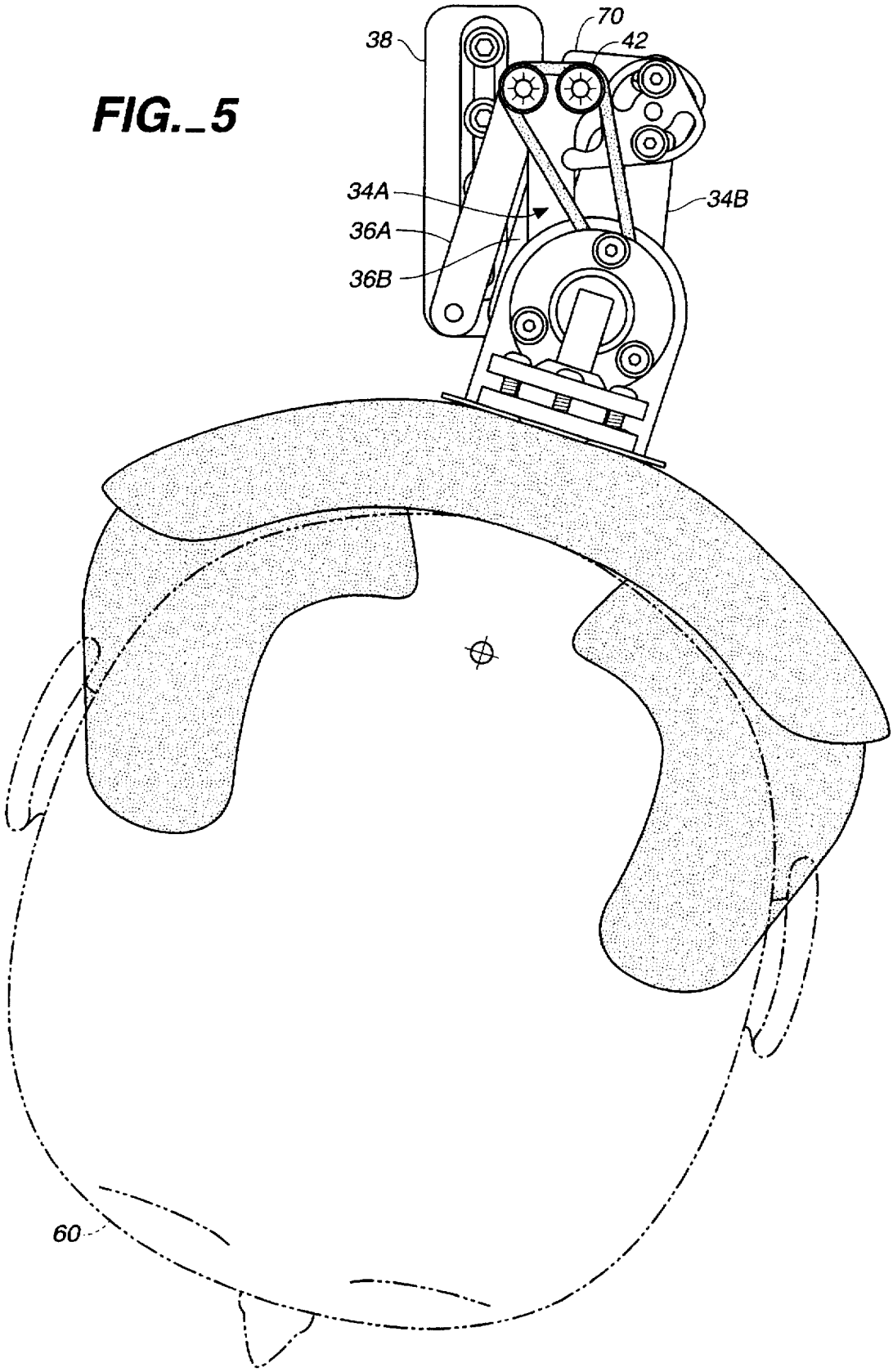
FIG. 5 is a top plan view of the headrest assembly showing rotation of the assembly clockwise from FIG. 3, with the patient's head shown in phantom.

The top view show in FIG. 3 reveals more detail of the mounting assembly 20. Forwardly extending arm 34 is comprised of two separate arms 34A and 34B. Connector 42 is comprised of a pair of connectors 42A and 42B. These connectors 42A and 42B both pass through arm 34A. Forwardly extending arm 34B is slightly inclined to arm 34A. Further structural details of the mounting assembly 20 are best revealed by viewing FIG. 4, which shows the maximum allowable rotation in one direction, and FIG. 5, which shows the maximum allowable rotation in the other direction. In FIGS. 4 and 5, arm 36 is clearly shown as a pair of arms 36A and 36B which are oriented parallel in space. Viewing FIGS. 3, 4, and 5 together, the rotational mechanism of the system is shown.

The maximum allowable rotation for the particular patient can be pre-set through a stop assembly comprising the cooperative use of a pair of bolts 48 and restraining members 50 and 52 in the following manner. Bolts 48 connect restraining members 50 and 52 to arm 34B. These bolts 48 also hold into position a pair of restraining members 50 and 52 which are positioned one on top of the other. When bolts 48 are loosened, restraining members 50 and 52 are free to move as allowed by slots 54 which are found in both restraining members 50 and 52. These slots 54 thus allow for some degree of rotation in these adjustable restraining members. Restraining member 50 has a notch 72 and restraining member 52 has a corresponding notch 70. These notches are positioned such that bolt 42A can move freely back and forth in the area between these notches as the headset 10 is rotated in either direction. As is seen in FIG. 4, when the headrest assembly is rotated to the maximum degree in the counter-clockwise from above direction, bolt 42A is restrained by the position of notch 72. As is seen in FIG. 5, when the headrest assembly is rotated to the maximum clockwise from above direction, bolt 42A is restrained by the position of notch 70. Working together, notches 70 and 72 operate to restrain bolt 42A such that the head assembly may not rotate beyond a limited maximum degree of rotation. By positioning restraining members 50 and 52, and fastening them in place with bolts 48, the maximum potential degree of rotation may be pre-set for each patient. This stop assembly is formed to be manually adjustable to a prescribed range of motion.

An important feature of the present invention is that it offers some resistance to unrestrained rotational movement. This is especially important in the case of patients with limited or reduced muscle control in the neck. For these patients, it is important to have a headrest system which offers some very gentle resistance to free rotation of the head. The system of the present invention provides this gentle resistance while also having the added benefit of gently guiding the patient's head back to a null, forward looking position. This guidance is done gently enough that the patient is able to rotate their head under their own control without having to work excessively against any stresses caused by the headrest assembly twisting their head back to a forward looking position. Furthermore, this mechanism for gently re-positioning the head also tends to prevent the head from freely slipping or sliding to the sides. The mechanism of this device is as follows.

As is best seen in FIGS. 3, 4, and 5, said linkage assembly further comprises a restraining elastic 46 wraps around pivot assembly 26 and connectors 42A and 42B. This elastic member 46 will naturally exert a force seeking to minimize the distance around pivot assembly 26 and connectors 42. The null, rest position shown in FIG. 3 occurs when elastic member 46 pulls pivot assembly 26 into forward facing alignment. As is shown in FIGS. 4 and 5, when the headrest assembly is rotated from the position as shown in FIG. 3, the elastic member 46 is stretched thus exerting a force tending to return the headrest assembly to its forward facing position. Being elastic, member 46 exerts a greater and greater force to return the headrest assembly to a forward facing orientation as the rotational displacement increases in either direction. This has the added benefit of ensuring that the patient's head can be slightly displaced under the patient's own power, while gently guiding the head back to a forward-looking position when the rotational displacement becomes too large. For patients with limited or reduced neck strength, it is easy to make the small rotational displacements they desire yet difficult to make large rotational displacements which are undesirable.

Figure 3A:
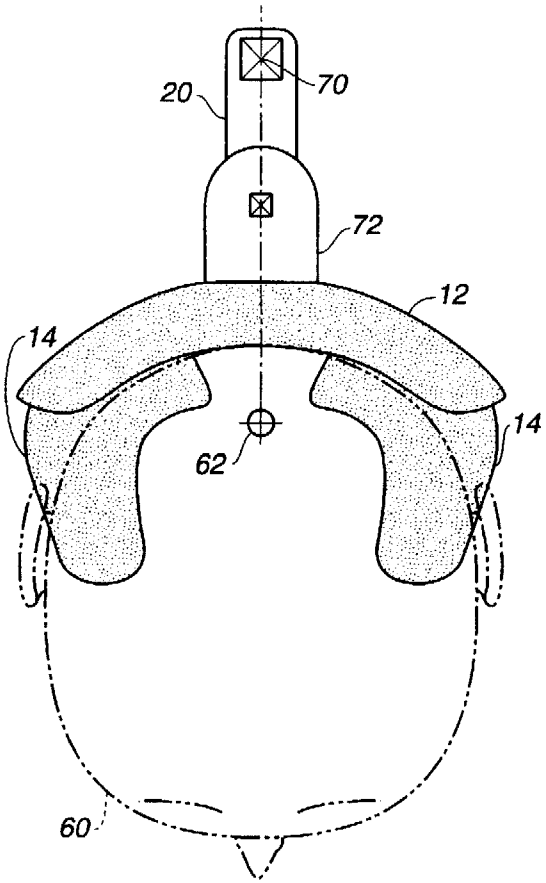
FIG. 3A is a top plan, reduced scale, schematic view of the headrest assembly corresponding to FIG. 3.

Another important feature of the invention is to allow the patient's rotation of their head to be in a horizontal plane around a vertical axis that substantially coincides with their spinal column. This form of rotation is the most natural for the patient. As such, it avoid placing excessive stress on the patient's head, neck and shoulder regions. Many prior art systems that have allowed the patient to rotate their head have required the rotation of the patient's head to be about a vertical axis defined by some structural member of the headrest, rather than by the patient's own spinal column. It is a major object of the present invention to overcome these unnatural rotational motions which place unnecessary strain on the patient's neck and shoulders. As is best seen in FIGS. 3A, 4A and 5A, the head 60 of the patient rotates about vertical axis 62. This vertical axis 62 is intended to coincide as closely as possible with the patient's spinal column. Point 70 represents the axis through which the headrest assembly is mounted to a wheelchair. Assembly 72 represents a composite of the various parts of the mounting assembly 20 which hold the supporting cushions 12 and 14 in place. As can be seen, the distance from axis 62 to axis 70 remains constant despite the rotational movement of assembly 72 and cushions 12 and 14 attached to said assembly 72.

Figure 8:
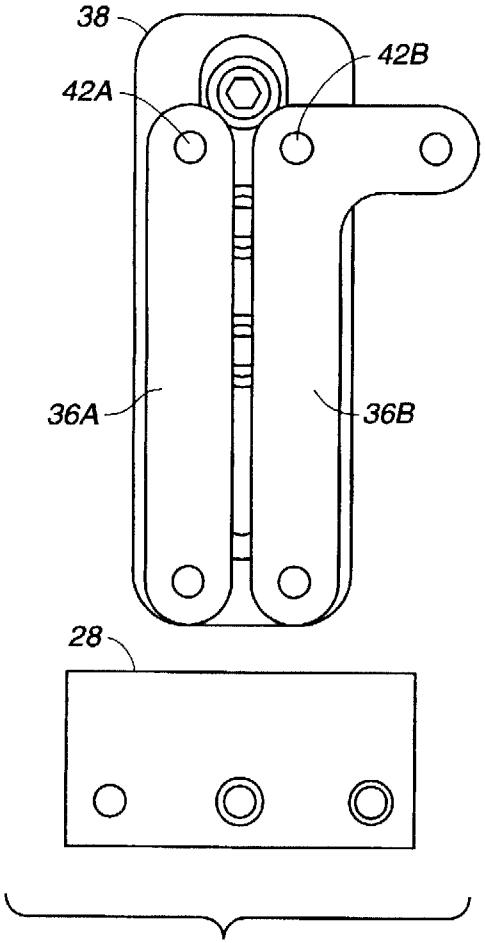
FIG. 8 is a top plan cross-sectional view of the rotational mounting assembly of the present invention taken substantially along the plane of line 8—8 in FIG. 1.
Figure 7:
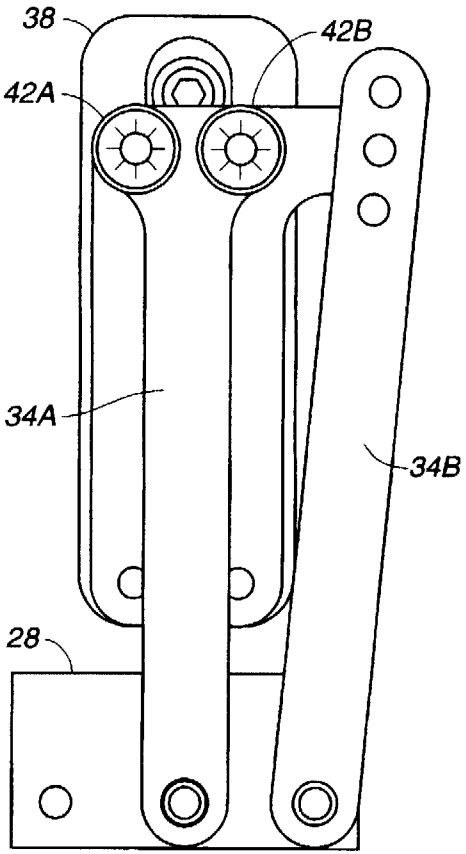
FIG. 7 is a top plan cross-sectional view of the rotational mounting assembly of the present invention taken substantially along the plane of line 7—7 in FIG. 2.
Figure 6:
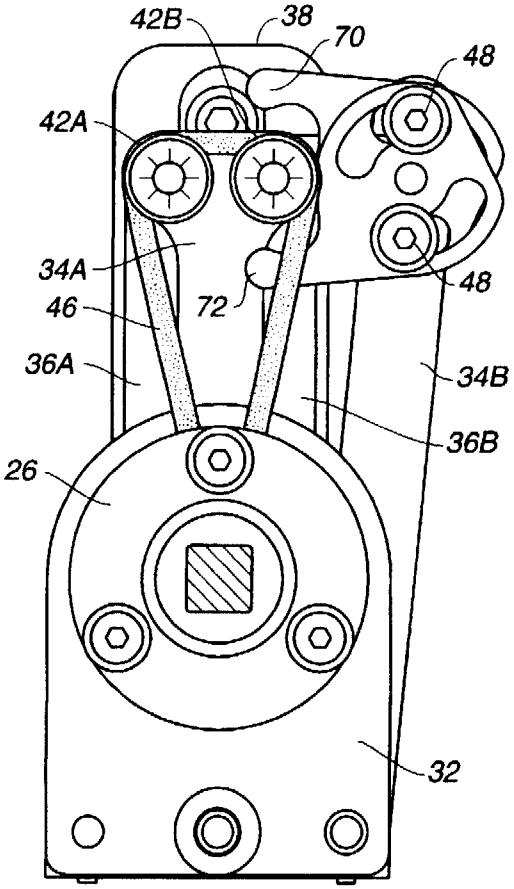
FIG. 6 is enlarged, top plan cross-sectional view of the rotational mounting assembly for the headrest assembly of the present invention taken substantially along the plane of line 6—6 in FIG. 2.

Further structural details of the mounting assembly 20 as seen in downward looking cross sectional views taken from FIG. 1 along lines 6—6, 7—7 and 8—8 respectively. The paired nature of forwardly extending arms 34A and 34B is clearly seen in FIG. 7 and the paired nature of arms 36A and 36B is clearly seen in FIG. 8.

Lastly, as best seen in FIGS. 1 and 2, extension member 22 which is used for connection to a wheelchair is connected to mounting assembly 20.

What is claimed is:

1. A headrest, suitable for attachment to a wheelchair seating system, comprising:

a) a cushioned backpad, b) a pair of laterally spaced apart cushioned sidepads, c) a mounting assembly, said backpad and said sidepads being carried by said mounting assembly, and said mounting assembly extending rearwardly of said backpad and said sidepads to a wheelchair mounting structure, said mounting assembly including a plurality of arms pivotally connected between said mounting structure and said backpad and said sidepads and forming a linkage assembly, said linkage assembly mounting said backpad and said sidepads together for rotation as a unit about a vertical axis located forward of said mounting structure, and a stop assembly moveably mounted and securable to said linkage assembly, said stop assembly being manually adjustable to limit rotation of said linkage assembly to a prescribed range.

2. The apparatus of claim 1 wherein, said linkage assembly includes a biasing device exerting a force resisting rotational displacement of said mounting assembly, and to return said mounting assembly to a null, forward facing orientation.

3. The apparatus of claim 2 wherein, said biasing device is provided by an elastic member connected between said arms of said linkage assembly to exert said force.

4. The apparatus of claim 2 wherein, said biasing device increases said force with a corresponding increase in said rotational displacement.

5. A linkage assembly, suitable for use in a wheelchair headrest mounting assembly, said headrest mounting assembly providing a backpad and a pair of sidepads which rotate together as a unit about a vertical axis located forward of said mounting assembly, comprising:

a) a bottom arm formed for attachment to the frame of a wheelchair, b) a pair of substantially parallel lower intermediate arms positioned above and pivotally connected to said bottom arm, said lower intermediate arms being mounted to move in a first horizontal plane above and parallel to said bottom arm, c) a pair of substantially parallel upper intermediate arms positioned above and pivotally connected to said pair of lower intermediate arms, each upper intermediate arms being pivotally connected to only one lower intermediate arm, and said upper intermediate arms being mounted to move in a second horizontal plane above and parallel to said first horizontal plane, and said sidepads being mounted to said upper intermediate arms; and d) a top arm, positioned above and pivotally connected to said pair of upper forwardly extending arms, and said top arm being mounted to move in a third horizontal plane above and parallel to said second horizontal plane, and said backpad being mounted to said top arm.

6. The linkage assembly of claim 5 further comprising:

a) an elastic member connected between one of said upper intermediate arms and said top arm.

* * * * *